US005719347A

United States Patent [19]

Masubuchi et al.

[11] Patent Number: 5,719,347

[45] Date of Patent: Feb. 17, 1998

[54] KEYBOARD APPARATUS FOR ELECTRONIC MUSICAL INSTRUMENT WITH KEY DEPRESSION DETECTION UNIT

[75] Inventors: Takamichi Masubuchi; Toshiyuki Iwamoto, both of Shizuoka-ken, Japan

[73] Assignee: Yamaha Corporation, Hamamatsu, Japan

[21] Appl. No.: 541,255

[22] Filed: Oct. 12, 1995

[30] Foreign Application Priority Data

Dec. 7, 1994 [JP] Japan ..... 6-303292

[51] Int. Cl.[6] ..... G10C 3/04; G10C 3/12

[52] U.S. Cl. ..... 84/687; 84/719; 84/744

[58] Field of Search ..... 84/687, 719, 720, 84/744, 745

[56] References Cited

U.S. PATENT DOCUMENTS

| | | | |
|---|---|---|---|
| 3,979,990 | 9/1976 | Hinago | 84/719 |
| 5,453,571 | 9/1995 | Adachi et al. | 84/658 |
| 5,495,074 | 2/1996 | Kondo et al. | 84/690 |

FOREIGN PATENT DOCUMENTS

| | | |
|---|---|---|
| 55-35716 | 9/1980 | Japan . |
| 56-2717 | 1/1981 | Japan . |

*Primary Examiner*—William M. Shoop, Jr.
*Assistant Examiner*—Marlon Fletcher
*Attorney, Agent, or Firm*—Loeb & Loeb LLP

[57] ABSTRACT

A keyboard apparatus for an electronic musical instrument includes a key displacement detection unit. The key displacement detection unit includes a first resilient member, a movable member connected to the first resilient member, a second resilient member connected to the movable member, and a base fixing member connected to the second resilient member. The base fixing member may be directly or indirectly fixed to a keyboard musical instrument so that the key displacement detection unit is mounted to the keyboard musical instrument. A first displacement detection sensor is coupled with the first resilient member for detecting a key depression force in a key depression-release direction, and a second displacement detection sensor is coupled with the second resilient member for detecting a key depression force in a key arrangement direction. Both the first displacement detection sensor and the second displacement sensor are mounted on the key displacement detection unit. The first resilient member and the second resilient member are connected to the movable member in a folded manner. As a result, the key displacement detection unit becomes small in size and yet provides a relatively large displacement in the first and the second resilient members with a relatively small key depression force.

22 Claims, 8 Drawing Sheets

KEYBOARD APPARATUS FOR ELECTRONIC MUSICAL INSTRUMENT WITH KEY DEPRESSION DETECTION UNIT

BACKGROUND OF THE INVENTION

1. Field of the Invention

This invention relates to a keyboard apparatus for an electronic musical instrument, and more particularly, to an improvement in a key depression detection device for controlling musical sound.

2. Description of Related Art

There is a variety of conventional technology available to broaden and enrich the musical expression in a musical performance by a keyboard apparatus of an electronic musical instrument. For example, when a key depression force is applied to a key, key depression force components of the key depression force in a key depression-release direction (generally a vertical direction) and a key arrangement direction (generally a horizontal direction) are detected during a key stroke in which a key is being depressed or after a key stroke. Timbre, loudness, pitch, reverberation, pan, vibrato and other musical sounds are controlled based upon the information of the key depression force.

For example, Japanese patent SHO 56-2717 and Japanese patent SHO 55-35716 describe key depression pressure detection devices similar to the type described above in which a key depression force in the key depression-release direction and the key arrangement direction are detected for controlling the musical sounds.

A keyboard apparatus in accordance with Japanese patent SHO 56-2717 has an apparatus frame and a keyboard frame equipped with numerous keys. The keyboard frame is mounted to the apparatus frame by means of a pivot arm. The pivot arm has two fulcrums that allow the keyboard frame to move up and down (in the key depression-release direction) and to move right and left (in the key arrangement direction). The keyboard frame is movably supported by the pivot arm in a manner so that the keyboard frame can assume movement in the key depression-release direction and in the key arrangement direction. A detection device is provided to detect displacements in the keyboard frame caused by the up and down movement and the right and left movement applied to a key, and provides a detection output as a control signal based on the detected displacements. By the control signal, musical acoustic effects of an electronic musical instrument are controlled.

A keyboard apparatus for an electronic musical instrument in accordance with Japanese patent SHO 55-35716 has a first frame that is provided in the musical instrument body. The first frame is supported in a manner so that the first frame is pivotable in the key depression-release direction and shiftable in the key arrangement direction. The keyboard apparatus also includes keys that are pivotally disposed on the first frame in a manner that the keys are pivotable in the key depression-release direction. A coil spring is provided between the musical instrument body and the rear end, central portion of the first frame. When a key is released, the conical spring automatically returns the first frame which has moved in the key depression-release direction and the key arrangement direction, to an original position. Two pick-up devices are provided at the back of the coil spring for independently detecting the movement of the first frame in the key depression-release direction and the key arrangement direction.

In the keyboard structures described in the above references, a detection device for detecting a key depression force in the key depression-release direction and a detection device for detecting a key depression force in the key arrangement direction are separately mounted in the musical instrument body. As a result, the position of each device with respect to the musical instrument body or the position of one detection device with respect to the other detection device have to be adjusted at the time of assembly of the musical instrument. Accordingly, the assembly work is relatively difficult.

More particularly, in the keyboard apparatus according to Japanese patent SHO 56-2717, an angle shaped mounting member is fixed to the musical instrument body, and detection devices formed from photovoltaic elements are mounted to the angle shaped member for detecting the movements in the key depression-release direction and the key arrangement direction. A shutter member (shutter plate) is fixed to the keyboard frame with respect to the detection device for detecting the movement in the key arrangement direction. Another shutter plate is fixed to a support plate that is used for mounting the detection device for detecting the movement in the key depression-release direction in a manner that this shutter plate is movable in the key depression release direction by a drive arm provided on the keyboard frame. In accordance with this structure, the detection devices and the shutter plates have to be mounted independently from one another on separate members. Namely, the detection devices are mounted on the musical instrument body and the shutter plates are connected to the keyboard frame that move with respect to the detection devices.

In a similar manner, in the keyboard structure in accordance with Japanese patent SHO 55-35716, a detection device formed from a photoconductive element is mounted on a frame that is fixed with respect to the musical instrument body. Shutter plates are fixed to a first frame (key frame). The shutter plates shut the light from the detection device in response to movements in the key depression-release direction and key arrangement direction to thereby detect displacements caused by the movement of the first frame in the key depression-release direction and the key arrangement direction. Therefore, in this structure, the detection devices and the shutter plates are individually mounted on separate members.

In the above described references, the key displacement detection devices for detecting the key depression pressure components in the key depression-release direction and in the key arrangement direction and other associating members have to be separately mounted for assembly. Therefore, the position of the devices and the members with respect to the musical instrument body or the relative position of the devices and the members has to be adjusted during the assembly work. This requires precise positioning during the assembly work to control very delicate musical sounds of the musical instrument. As a result, the assembly work becomes very difficult and the maintenance and repair of the detection devices require substantial labor.

Furthermore, for an after-control of musical sound performed after a key stroke, a stopper device is required to limit the range of the control in the key depression-release direction and in the key arrangement direction. However, clearance adjustment with respect to the stopper device is very sensitive, and the stopper device becomes heavy if the stopper device is built to be shock-proof or made to be resistant to damage. Moreover, if the stopper devices for detecting key depression force in the key arrangement direction and in the key depression-release direction are assembled and adjusted independently from one another, the overall assembly work becomes complicated and the maintenance work cannot be readily performed.

Further, a leaf spring is often used as a resilient member for detecting the movement in the key depression-release direction or in the key arrangement direction. Leaf springs are used, since they are readily manufactured and assembled into a displacement detection device with threaded screws or the like. In a displacement detection device using a leaf spring, a moment force to be detected is determined by the length of the leaf spring. Therefore, the leaf spring has to be made long in order to increase a moment force and thus the reliability of a detection. As a result, this creates problems because the keyboard structure becomes large, since a large space is required for accommodating the long leaf spring. Furthermore, where the leaf springs are fixed to the musical instrument body at a fixing point, if the leaf spring is very long, a large moment acts on the musical instrument body at the fixing point. Such large moment forces have adverse effects on the musical instrument body to an extent that the musical instrument body may deform or parts of the musical instrument may dislocate with each other. Also, if one end of the leaf spring is dislocated from a specified location by even a minor or small amount, the position of the other end thereof may be substantially shifted so that the adjustment and assembly work involving the leaf springs become difficult.

SUMMARY OF THE INVENTION

It is an object of the present invention to provide a keyboard apparatus for an electronic musical instrument having a displacement detection device that is readily assembled and facilities clearance adjustments. Moreover, the displacement detection device in accordance with an embodiment of the present invention has greater structural strength and substantially reduces assembly errors, while still being small in size and capable of detecting large moment forces.

In accordance with an embodiment of the present invention, a keyboard apparatus for an electronic musical instrument includes a fixing member, a first resilient member, a second resilient member, a first displacement detection sensor coupled with the first resilient member for detecting a key depression force in a key depression-release direction, and a second displacement detection sensor coupled with the second resilient member for detecting a key depression force in a key arrangement direction. The fixing member supports the second resilient member in a manner movable in the key arrangement direction. The fixing member also supports the first resilient member in a manner movable in the key arrangement direction and in the key depression direction by means of the second resilient member. The first resilient member and the second resilient member (and preferably, the first and second displacement detection sensors) are assembled as a unit. The fixing member of the assembled unit is then removably attached to a base member which is in turn fixed to a shelf board or the like in the body of a musical instrument. As a result, individual positioning of components, such as a resilient member and a displacement detection sensor, in the displacement detection device is not required when the musical instrument is assembled.

In one embodiment, stoppers are provided in a displacement detection device as a part of the unit assembly to prevent excessive load that may be applied to the resilient members in the key depression-release direction or in the key arrangement direction. For example, clearances between the stoppers and the other components in the displacement detection device can be adjusted before the unit assembly is fixed to the base member, and in advance of the overall assembly of the musical instrument. Since positioning and clearance adjustment of the various components in a displacement detection device can be performed before the displacement detection device is mounted in a musical instrument, the overall assembly work is simplified and made more efficient.

In accordance with another embodiment of the present invention, one end of the second resilient member is fixed to the fixing member and the other end of the second resilient member is fixed to a movable member that is movable in the direction of the key arrangement. Further, one end of the first resilient member is fixed to the movable member and the other end of the first resilient member extends over and beyond the fixing member so that a key depression force is applied to an area adjacent the other end of the first resilient member. In this embodiment, the first resilient member is used for detecting the displacement in the key depression-release direction is formed substantially as a folded structure in combination with the second resilient member and the movable member. As a result, the space required for mounting the displacement detection device is reduced, and yet a large moment force can be detected with the short resilient member. Therefore, a specified key depression force generates a smaller moment in the folded structure as compared with that of a non-folded type structure. As a result, effects of a moment force on the base member of the musical instrument are reduced. On the other hand, the second resilient member for detecting displacement in the key arrangement direction is also formed substantially as a folded structure in combination with the movable member and the first resilient member. As a result, the entire structure becomes compact, and the clearance between the stoppers and the other components in the displacement detection device are not readily affected by a mounting angle error that may occur where the displacement detection device is mounted to the musical instrument or by a deformation at the mounting section.

In accordance with still another embodiment of the present invention, the second resilient member for detecting displacement in the key arrangement direction is mounted on each of the side ends of the fixing member that forms a part of a displacement detection device. Since the displacement detection device is provided with a plurality of second resilient members, the rigidity of the unit assembly in the key arrangement direction is enhanced. Accordingly, when the fixing member of the unit assembly is fixed to the base member with screws, an excessive stress will not be generated in the resilient members. Also, the mounting angle between the unit assembly and the base member will not be changed by the moment force that is generated by the screw tightening work, and thus the unit is assembled with a high precision.

In accordance with a further embodiment of the present invention, the fixing member includes protrusions on both sides that protrude from the base member side in the key depression-release direction and a connection section that connects the protrusions. The connection section and the protrusions generally define a U-shaped cross-section or a channel as viewed from the front. The second resilient member is fixed to each protrusion, and the first resilient member extends over an upper surface of the connection section. Further, a clearance is formed between each side edge of the first resilient member and each of the protrusions to allow the first resilient member to move in the key arrangement direction, and a clearance in the key depression-release direction is formed between a lower surface of the first resilient member and an upper surface of the connection section to allow the first resilient member to elastically deform in key depression-release direction. The protrusions on both ends of the mixing member and the connection section of the fixing member define stopper devices that limit the ranges of movement of the first resilient member in the key arrangement direction and in the key release-depression direction, respectively.

Further, in accordance with another embodiment of the present invention, the first displacement detection sensor for the first resilient member and the second displacement detection sensor for the second resilient member are fixed adjacent the fixing members. As a result, the structure of the unit assembly becomes compact in size and displacements can be detected with high precision.

In accordance with an embodiment of the present invention, each of the protrusions provided at both ends of the fixing member has a recess facing the interior side of each of the second resilient members so that the second resilient members can move in the key arrangement direction within a range defined by the recesses.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 1 is an exploded perspective view of a displacement detection device used for a keyboard apparatus of an electronic musical apparatus in accordance with an embodiment of the present invention.

FIG. 2 is a plan view of a displacement detection device of FIG. 1 mounted on the body of a musical instrument.

FIG. 3 is a partial cross-sectional side view of a structure of a keyboard musical instrument equipped with a displacement detection device of FIG. 1.

FIG. 4 is a view for explaining the relation between a key depression force and a moment generated in a keyboard musical instrument in accordance with an embodiment of the present invention.

FIG. 5 is a plan view of a sensor assembly mounted to a displacement detection unit in a keyboard musical apparatus in accordance with an embodiment of the present invention.

FIG. 6 is a side view of a sensor assembly mounted to a displacement detection unit in a keyboard musical apparatus in accordance with an embodiment of the present invention.

FIG. 7 is a plan view of displacements detection units mounted to both end sides of a guide frame in accordance with an embodiment of the present invention.

FIG. 8 is a plan view, that is similar to FIG. 7, used for explaining disadvantages which may arise from removing part of components used in an embodiment shown in FIG. 7.

DETAILED DESCRIPTION OF EMBODIMENTS

Figure 1:
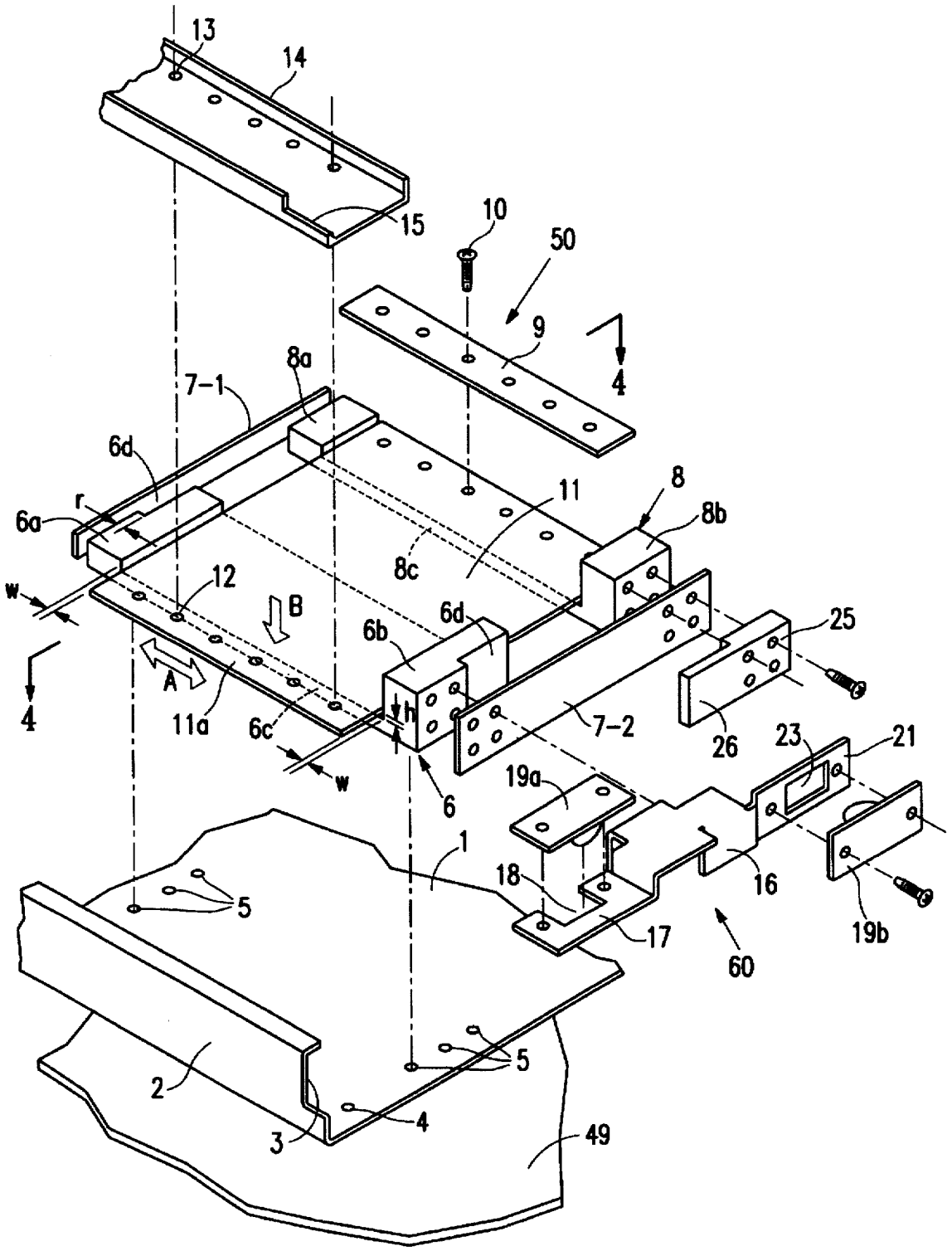
FIGS. 1 –8 shows key displacement detection unit assemblies in accordance with embodiments of the present invention.

FIG. 1 is a exploded perspective view of a displacement detection mechanism formed in a unit in a keyboard apparatus in accordance with an embodiment of the present invention. A base member 1 is fixed to a main body of a musical instrument (a shelf plate) 49 by an appropriate means, such as screws 61 (see FIG. 6) or the like, at mounting apertures 4. The base member 1 has a front cover 2 that is formed at the side of a user. A recess 3 is provided at an end portion of the front cover defining a space for mounting a sensor assembly that is described later. A fixing block 6 is fixed to the base member 1 by an appropriate means, such as screws or the like, at apertures 5. The fixing block 6 includes protrusions **6*a* and 6*b* at both ends that extend upwards and a connecting section 6*c* that connects the protrusions 6*a* and 6*b*. The fixing block 6 has a generally U-shaped cross-section defined by the protrusions 6*a* and 6*b* and the connecting section 6*c* as viewed from the front. Leaf springs 7-1 and 7-2 that resiliently deform in a key arrangement direction are attached at one end to the exterior sides of the protrusions 6*a* and 6*b*. A recess 6*d* for allowing elastic deformation of each of the leaf spring 7-1 and 7-2 is formed on each of the protrusions 6*a* and 6*b* at the exterior side of each of the protrusions 6*a* and 6*b* facing the interior side of each of the leaf springs 7-1 and 7-2. The recess 6*d* provides a clearance r for allowing each of the leaf springs 7-1 and 7-2 to flex in the key arrangement direction so that a range for the elastic movement of each of the leaf springs 7-1 and 7-2 is expanded. As a result, the fixing block 6 can be made long in the depth direction (the longitudinal direction of a key) to enhance the structural strength, and the length of the leaf springs 7-1 and 7-2 can be made short, since the range of elastic deformation of each of the leaf springs 7-1 and 7-2 is expanded by the recesses 6*d***.

The other end of each of the leaf springs 7-1 and 7-2 is fixed to a movable block 8 that is movable in the key arrangement direction. The movable block 8 includes protrusions **8*a* and 8*b* provided at both ends and a connecting section 8*c* that connects the protrusions 8*a* and 8*b*, in a manner similar to that of the fixing block 6. The leaf springs 7-1 and 7-2 are fixed to the exterior sides of the associated protrusions 8*a* and 8*b*. A leaf spring 11 to be used for detecting a key depression force in a key depression-release direction (which is transverse to the key arrangement direction) is fixed at one end to the connecting section 8*c* of the movable block 8 by means of a retainer plate 9 and a plurality of screws 10 (only one screw is shown in FIG. 1) or the like. The other end 11 a of the leaf spring 11 extends over and beyond the connecting section 6*c* of the fixing block 6**.

A guide frame 14 is fixed to the end portion **11*a* of the leaf spring 11 that extends beyond the connecting section 6*c* by means of screws (not shown) or the like screwed through mounting screw apertures 12 and 13. The guide frame 14** also serves to enhance the structural strength of the keyboard.

Figure 3:
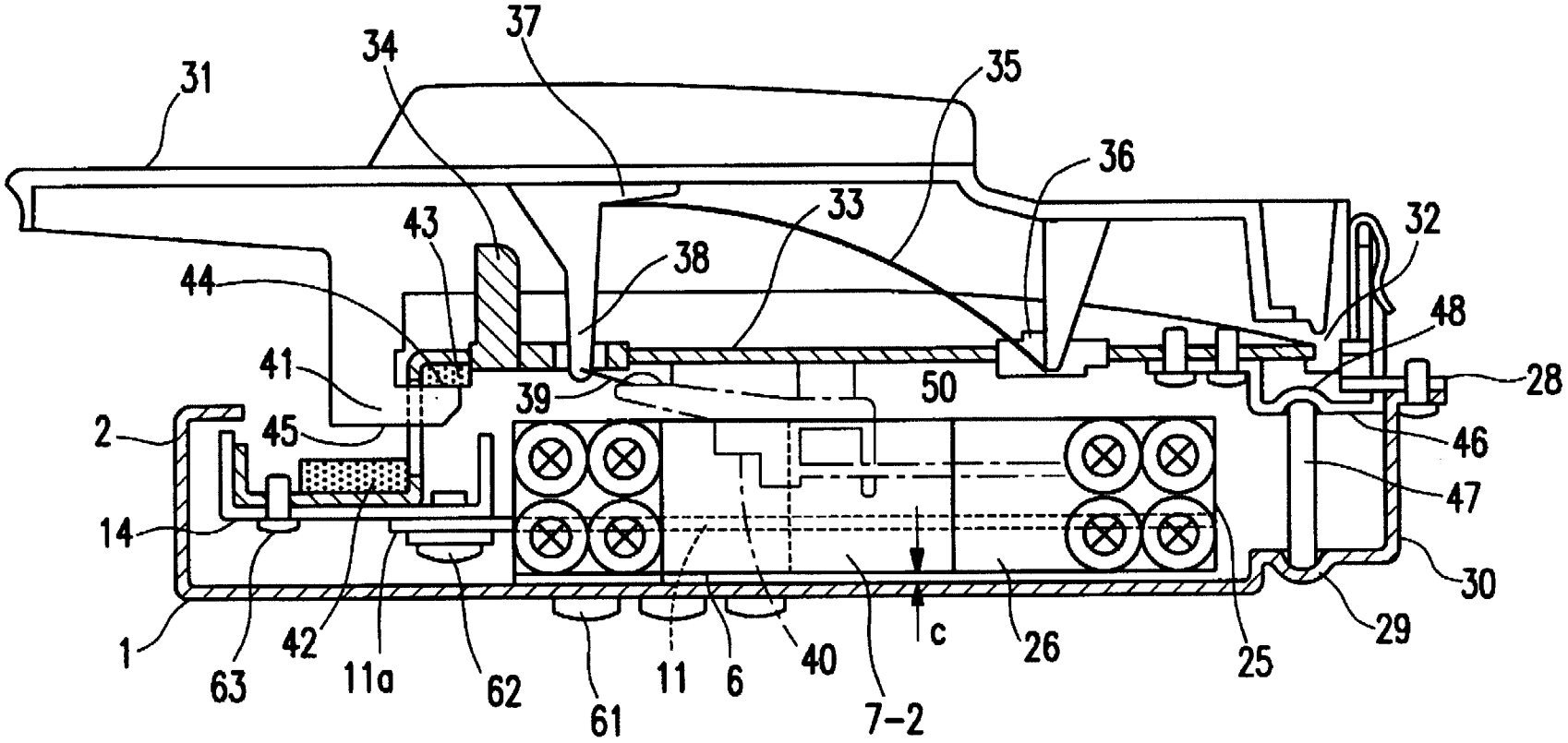

The guide frame 14 has a recess 15 provided at one end which is adapted for mounting a sensor assembly (that is described later). The guide frame 14 is coupled to a lower end surface of a key frame 33 that supports a key (as shown in FIG. 3) for transferring the key depression force applied to the key frame 33 in the key depression-release direction and in the key arrangement direction to the end portion **11*a* of the leaf spring 11. Namely, the leaf spring 11 receives the key depression force at the end portion 11*a*. The leaf spring 11 is movable in the key depression-release direction and in the key arrangement direction due to clearances h and w, respectively, that are provided between the leaf spring 11 and the protrusions 6*a* and 6*b* and the connecting sections 6*c* of the fixing block 6. The leaf spring 11** assumes displacement in response to the key depression force in the key arrangement direction and the key depression-release direction.

A sensor assembly 60 is provided at the exterior side of one of the two leaf springs 7-1 and 7-2 (in preferred embodiments at the side of the leaf spring 7-2), for detecting displacement in the leaf springs in the key depression-release direction and in the key arrangement direction that are caused by depressing an associated key. The sensor assembly 60 includes a bracket 16 having sensor support sections 17 and 21 that define a support surface in the key arrangement direction and a support surface in the key depression-release direction, respectively. The bracket 16 is fixed to the protrusion 6b of the fixing block 6. The sensor support section 17 and 21 define apertures 18 and 23, respectively. A displacement detection sensor 19a for detecting displacement in the key depression-release direction and a displacement detection sensor 19b for detecting displacement in the key arrangement direction are mounted at the aperture 18 and at the aperture 23, respectively. The displacement detection sensor 19a is disposed opposing the guide frame 14. An actuator block 25 is fixed to the protrusion 8b of the movable block 8. A pressure plate section 26 of the actuator block 25 is disposed opposing the displacement detection sensor 19b.

In accordance with the structure described above, when a key depression force is applied to the end portion 11a of the leaf spring 11 by means of the guide frame 14, the leaf spring 11 assumes displacement in response to the key depression force at least in the key depression-release direction. When a key depression force includes depression force components in the key arrangement direction and in the key depression-release direction, the leaf spring 11 assumes displacement in the key arrangement direction and in the key depression-release direction, as described later. In case a key depression force is applied diagonally with respect to the end portion 11a of the leaf spring 11 or in the key arrangement direction, the two leaf springs 7-1 and 7-2 flex in the key arrangement direction to generate a displacement in the key arrangement direction. The displacements are detected by the displacement detection sensors 19a and 19b.

The leaf spring 11 for detecting the key depression force in the key depression-release direction, the two leaf springs 7-1 and 7-2 for detecting the key depression force in the key arrangement direction, the fixing block 6, the movable block 8 are assembled as a unit to define a displacement detection unit 50. Before the displacement detection unit 50 is mounted to the musical instrument, the displacement detection unit 50 is subjected to a clearance adjustment to determine the range of displacement of the resilient members. An assembly of the displacement detection unit 50, after the clearance adjustment is completed, is mounted to the base member 1 by the fixing block 6. The displacement detection unit 50 and the base member 1 are then fixed to the musical instrument 49. In particular embodiments, the sensor assembly 60 and the actuator block 25 may be mounted on the displacement detection unit 50 in advance before the displacement detection unit 50 is installed on the musical instrument.

As shown in FIG. 1, clearances w and h are provided in the key arrangement direction and the key depression-release direction, respectively. As a result, when a key depression force is applied to the end portion 11a of the leaf spring 11 in the key depression-release direction as shown by an arrow B, the leaf spring 11 can elastically deform in the key depression-release direction in response to the key depression force. Also, when a force component of the key depression force is applied in the key arrangement direction as shown by an arrow A, the leaf spring 11 moves in response thereto in the key arrangement direction because the leaf springs 7-1 and 7-2 for detecting the key depression force in the key arrangement direction, which are coupled to the leaf spring 11, elastically deform in the key arrangement direction. Therefore, in the structure described above, the protrusions 6a and 6b provided at both ends of the fixing block 6 function as stoppers that limit the range of movements of the leaf spring 11 in the key arrangement direction (in the direction of the arrow A). Therefore, the stoppers in the key arrangement direction defined by the protrusions 6a and 6b indirectly function as stoppers for the leaf springs 7-1 and 7-2. The connection section 6c that connects the protrusions of the fixing block 6 functions as a lower limit stopper to limit the range of downward movement of the leaf spring 11 in the key depression-release direction.

Figure 2:
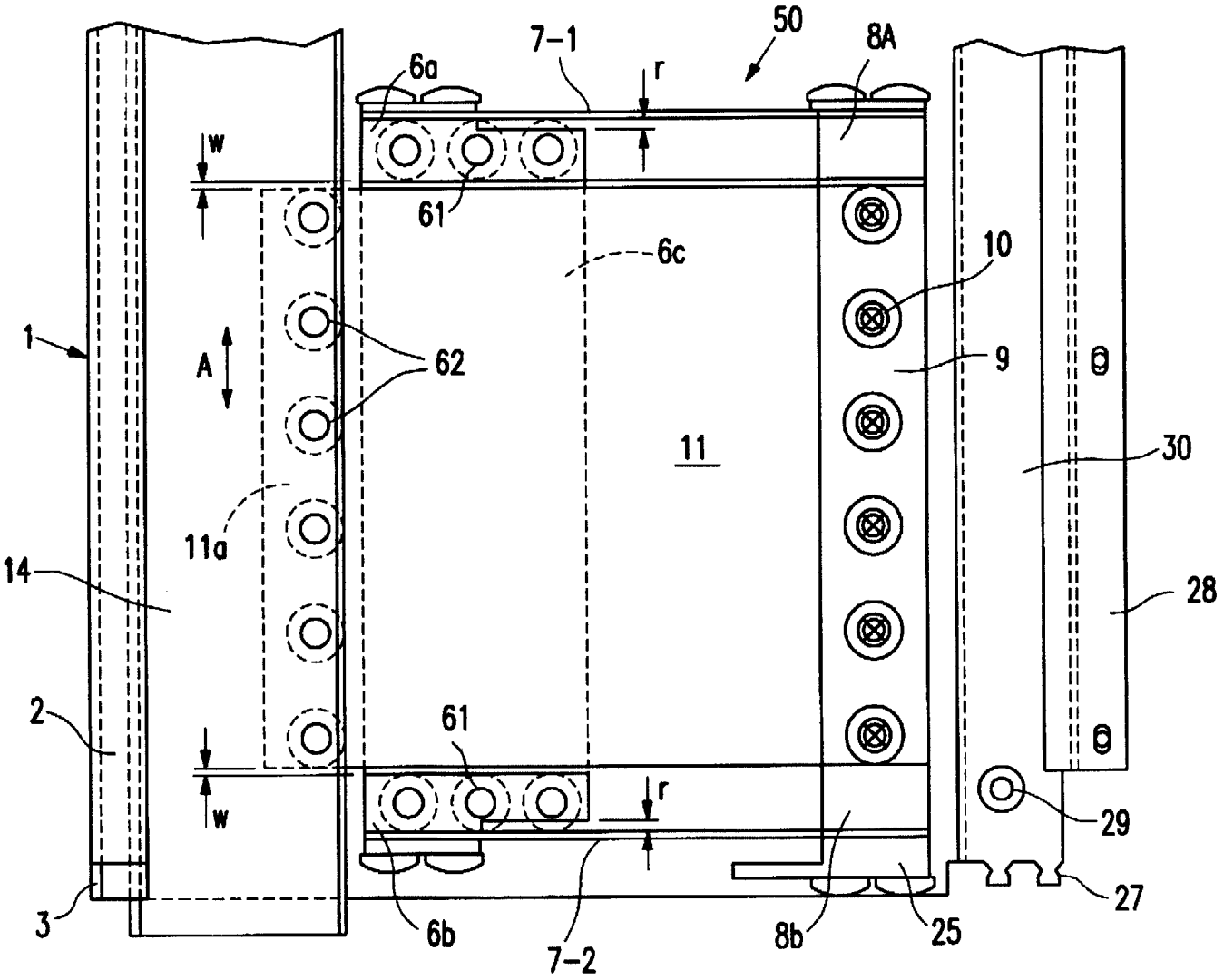

FIGS. 2 and 3 are a plan view and a side view, respectively, showing the displacement detection unit 50 mounted to the base member 1. In these figures, the sensor assembly 60 is omitted.

The fixing block 6 of the displacement detection unit 50 is fixed to the base member 1 by screws 61. However, in alternative embodiments, other connection members, such as rivets, nuts and bolts or the like may be used. The end portion 11a of the leaf spring 11 in the fixing block 50 is connected with screws 62 to the guide frame 14 that reinforces the keyboard and transfers the key depression force. The base member has a rear end portion 30 in which a pin receptacle 29 is formed. A key supporting member 33 has a rear portion fixed to a fulcrum receptacle member 46 that defines a pin receptacle 48. A pin 47 is held and supported between the pin receptacles 29 and 48. A tension spring (not shown) is disposed between the base member rear end portion 30 and the fulcrum receptacle member 46 with one end of the tension spring coupled to a spring receptacle 27. By the tension spring, the base member rear end portion 30 and the fulcrum receptacle 46 are resiliently coupled to each other through the pin 47. Therefore, the fulcrum receptacle member 46 fixed to the key frame 33 is movably supported without clatter while being separated a predetermined distance from the base member 1. A retainer member 28 is mounted between the base member rear end portion 30 and the fulcrum receptacle member 46 to securely connect the base member 30 and the and the fulcrum receptacle member 46.

As shown in FIG. 3, a key 31 is pivotally supported with respect to the key frame 33 about a fulcrum section 32 located at the rear end of the key frame 33. A return spring 35 is mounted between the key 31 and the key frame 33 with one end of the return spring 35 coupled to a spring receptacle section 37 at the key side and the other end of the spring 35 coupled to a spring receptacle section 36 at the key frame side. The return spring 35 pushes the key 31 upwardly and returns the key 31, after the key has been depressed, to the original position (non-key depression position).

A key guide 34 is fixed to the key frame 33 and is disposed within a space interior to the key 31. A generally L-shaped abutting member 41 is provided at the front end section of the key 31. The abutting member 41 has an angled section that defines an upper edge 44 and a lower edge 45. An upper limit stopper 43 and a lower limit stopper 42 are provided at the side of the key frame 33, respectively opposing the upper edge 44 and the loweredge 45. FIG. 3 shows an upper limit position in which the upper edge 44 of the abutting member 41comes in contact with the upper limit stopper 43.

An actuator 38 is provided in a frontal area adjacent the center of the interior space of the key 31. The actuator 38 drives a movable leaf spring 39 for detecting a contact time difference. As a result, initial key touch information is obtained from a key switch mechanism 40 that includes a fixed contactor.

Figure 4:
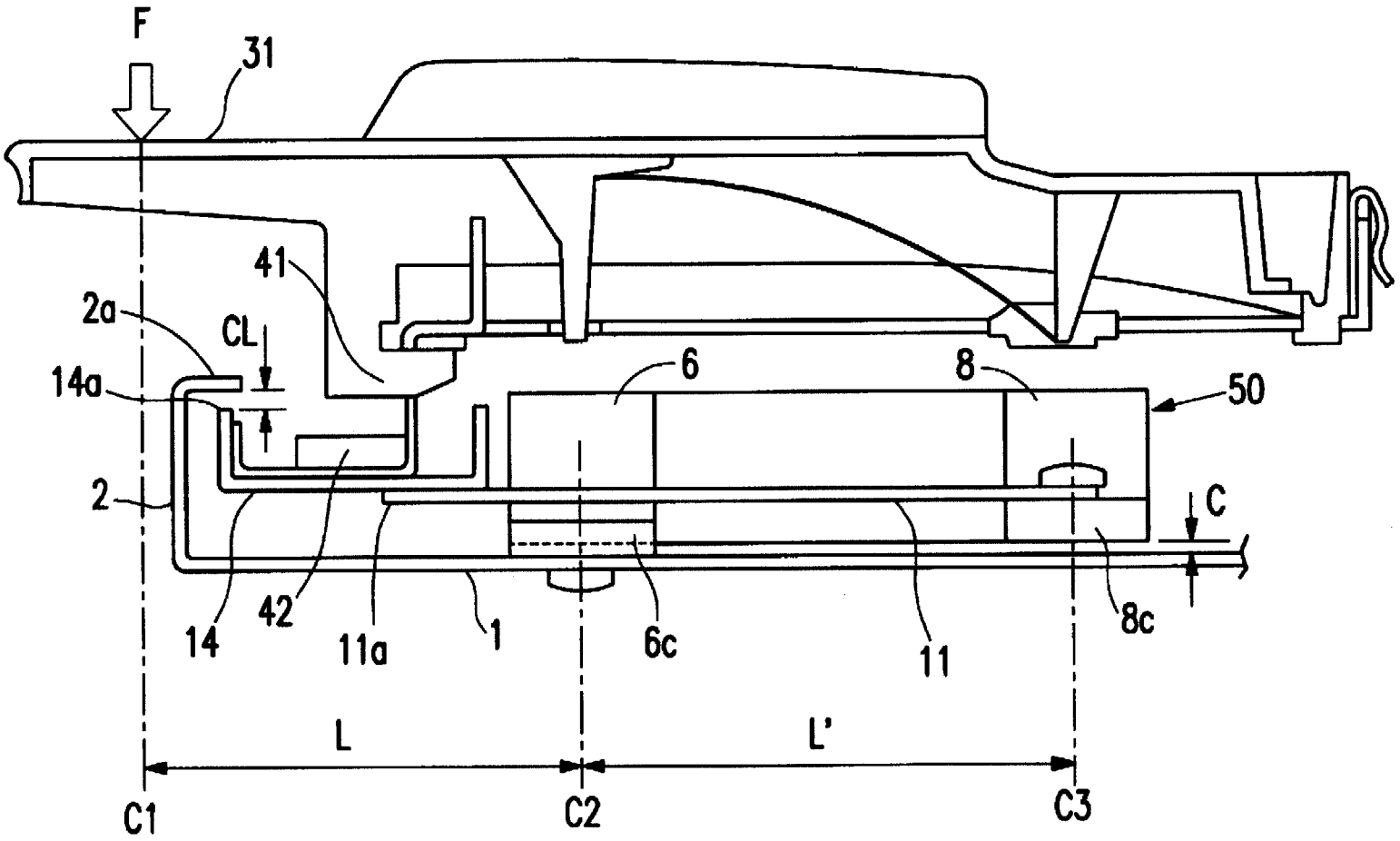

The guide frame 14 is fixed to the under side of the front end portion of the key frame 33 with screws 63 or the like. The guide frame 14 is connected to the front end portion 11*a* of the leaf spring 11 with screws 62 or the like, as described above. The displacement detection unit 50 is fixed to the base member 1 with screws 61 or the like at the fixing block 6. As shown in FIG. 4, a clearance C is provided between the lower ends of the leaf springs 7-1 and 7-2 that are provided at both sides of the displacement detection unit 50 and the upper surface of the base member 1 to provide smooth movement of the leaf springs 7-1 and 7-2 in the key arrangement direction and to allow the leaf springs to bend slightly in the key depression-release direction. As a result, the movable block 8 that is connected to the leaf springs 7-1 and 7-2 is maintained above and separated from the base member 1.

In the above described structure, when the key 31 is depressed, the lower edge 45 of the abutting member 41 comes in contact with the lower limit stopper 42 at the lower end of a key depression stroke. When the key 31 is further depressed, the key depression force is transmitted through the guide frame 14 to the front end portion 11*a* of the leaf spring 11 in the displacement detection unit 50. As a result, the leaf spring 11 assumes displacements. Depending upon the direction of the key depression force, the leaf spring 11 assumes displacements in the key depression-release direction, in the key arrangement direction, or in both the key depression-release direction and the key arrangement direction.

In accordance with the illustrated embodiment, when the key 31 is depressed, the lower end 45 of the abutting member 41 comes in contact with the lower limit stopper 42, and the front end portion 11*a* of the leaf spring 11 is downwardly pivoted and lowered by means of the guide frame 14 about the mounting section adjacent the connecting section 8*c*. When the front end portion 11*a* lowers (FIG. 3), the distance between the lower surface of the sensor support section 17 and the upper surface of the guide frame 14 becomes greater, as the sensor support section 17 of the bracket 16 is fixed to the fixing block 6. The sensor 19*a* detects the distance between the lower surface of the sensor support section 17 and the upper surface of the guide frame 14. In a preferred embodiment, the sensor 19*a* may detects a change in the distance between the lower surface of the sensor support section 17 and the upper surface of the guide frame 14.

When the key 31 is diagonally depressed (at least partially in the key arrangement direction) during the course of depression of the key or when the lower edge 45 of the abutting member 41 is in contact with the lower limit stopper 42, displacements caused by two key depression force components are detected by the sensors 19*a* and 19*b*. First, the sensor 19*a* detects a displacement caused by the force component in the key depression-release direction. At the same time, the key depression force is transmitted from the key 31, to the lower edge 45 of the abutting member 41, to the lower limit stopper 42, to the guide frame 14, to the leaf spring 11, to the protrusion 8*b* of the movable block 8, to the actuator block 25 and then to the pressure plate section 26. The key depression force may also be transmitted from the key 31 to the key guide 34, to the guide frame 14, to the leaf spring 11, to the protrusion 8*b* of the movable block 8, to the actuator block 25 and then to the pressure plate section 26. As a result, the pressure plate section 26 moves. When the key 31 is moved in the key arrangement direction to the higher pitch side, the pressure plate section 26 comes closer to a sensor mounting plate 20*b*'. When the key is moved to the lower pitch side, the distance between the pressure plate section 26 and the sensor mounting plate 20*b*' becomes greater. The sensor 19*b* detects the distance.

FIG. 4 is a cross-section taken along the line 4 —4 as shown in FIG. 1, illustrating the relation between the key depression force and the moment force when the above described key depression force is applied. A key depression force F is applied to the key 31 at a point C1. The displacement detection unit 50 is fixed at a point C2 to the base member 1 by means of the fixing block 6, Therefore, the point C2 substantially defines a fixing point at which the leaf spring 11 is fixed to the base member 1. More specifically, the rear end portion of the leaf spring 11 is fixed at a point C3 to the movable block 8 which is movably supported and spaced by the clearance C from the base member 1. The movable block 8 is not restricted by the base member 1. As a result, the leaf spring 11 defines a folded structure about the fixing point C3 on the movable block 8 with respect to the leaf springs 7-1 and 7-2 that are fixed to the side surfaces of the movable block 8 (see FIGS. 1 –3), and fixed at the point C2 with respect to the base member 1. Therefore, the key depression force F in the key depression-release direction applied to the key 31 is transmitted through the abutting member 41, the lower limit stopper 42 and the guide frame 14 to the front end portion 11*a* of the leaf spring 11. The downward key depression force in the key depression-release direction is further transmitted through the movable block 8 provided at the rear end of the leaf spring 11 and the leaf springs 7-1 and 7-2 fixed to the sides of the movable block 8, and received by the base member 1 at the point C2. Therefore, in the above folded structure, the base member 1 receives a moment force M at the point C2 that is defined by a formula $M = F \times L$, where F is the key depression force in the key depression-release direction and L is a distance between the points C1 and C2.

Let us assume that a displacement detection device does not use the folded leaf spring structure described above and instead uses a straight leaf spring having the same spring force as that of the leaf spring 11. To provide the same displacement for the same key depression force as the displacement provided by the above described folded leaf spring structure, the leaf spring should be extended rearwardly by a length L' from the point C3, where the distance L' is a distance between the points C2 and C3. In such a structure, the base member 1 would receive the key depression force F at a point located in a rearwardly extended line along the leaf spring 11 that is spaced the distance L' from the point C3. Therefore, the base member 1 receives a moment force M' at such a location that is defined by a formula $M' = F \times (L + 2L')$, which is greater than the moment force M generated in the above described folded structure.

Lever actions and moment forces are generated by the key depression force component in the key arrangement direction in a manner similar to the lever actions and moment forces generated by the key depression force in the key depression-release direction as described above. More particularly, a force component of the key depression force F in the key arrangement direction that acts on the key 31 at the point C1, is transferred to the key abutting member 41, to the lower limit stopper 42, to the guide frame 14 and to the front end portion 11*a* of the leaf spring 11. Further, the force component is transmitted through the movable block 8 located at the rear of the leaf spring 11, and resiliently bends the leaf springs 7-1 and 7-2 that extend forwardly from the both ends of the movable block 8. Then the force component in the key arrangement direction is received by the base member 1 located adjacent the front end portions of the leaf springs 7-1 and 7-2. Therefore, the leaf springs for detecting the key depression force in the key arrangement direction are formed in a folded structure in which the leaf springs are folded about the movable block 8. The base member 1 receives a moment force in a manner similar to the moment force generated by the key depression force applied in the key depression-release direction.

As described above, in the displacement detection unit in accordance with the present invention, the resilient members for detecting the key depression force in the key depression-release direction and in the key arrangement direction are formed in a folded structure. As a result, the structure of the unit has a relatively short depth and thus is compact in size. Further, the moment force that acts on a musical instrument is reduced, and thus the musical instrument experiences a reduced deformation. Moreover, a distance between a fixing point at which the resilient member is fixed to the base member and a point of application of the key depression force applied to the key is shortened. As a result, if the fixing point is slightly dislocated, the resultant effect on each of the resilient members is small. In contrast, in a non-folded structure, a slight dislocation of the fixing point results in a large variation in clearances between various components. For example, as shown in FIG. 4, a bent upper edge section 2*a* of the front cover 2 of the base member 1 and an upper end section 14*a* of the guide frame 14 function, in combination with the connecting section 6*c* of the fixing block 6, as a stopper to limit the range of deformation of the resilient members. If there is a slight dislocation in the fixing point in a non-folded structure, a clearance CL between the bent upper edge section 2*a* of the front cover 2 and the upper end section 14*a* of the guide frame 14 substantially varies. As a result, a very high assembling accuracy is required to fix the fixing block 6 to the base member 1. In contrast, because effects that may result from dislocation of the fixing point are small in the folded structure in accordance with an embodiment of the present invention, a relatively lower assembling accuracy is required to obtain a specified clearance, and thus the assembling work is simplified and made more efficient.

Also, to provide the same displacement amount in a resilient member, the folded structure requires a shorter resilient member than a resilient member that is required by the non-folded structure. In other words, the folded structure provides a compact structure that detects a key depression force as a large moment force as compared with the non-folded structure having the same resilient member under the same key depression force. As a consequence, the displacement detection unit is capable of detecting very delicate changes in the key depression force.

Figure 5:
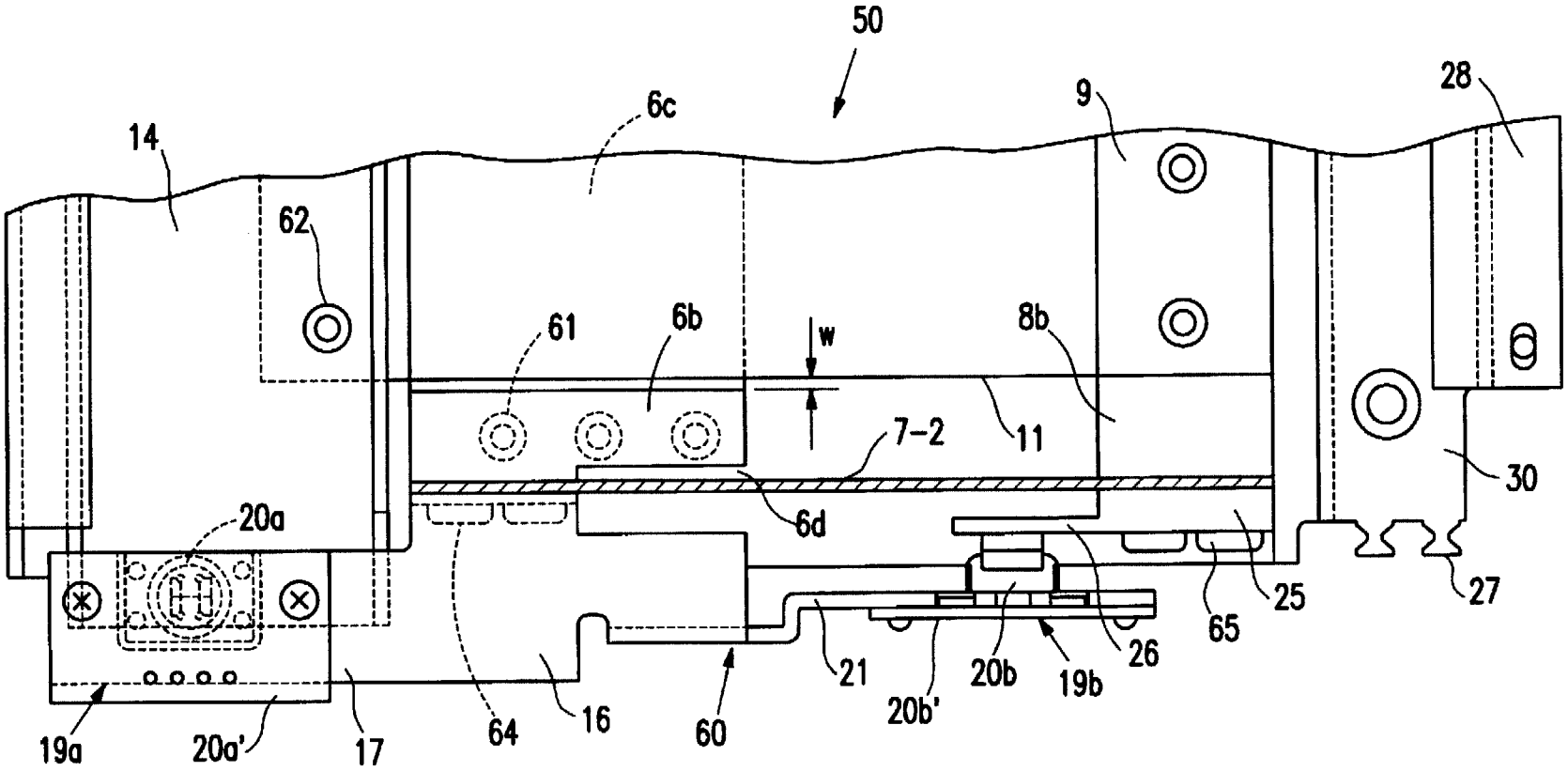
Figure 6:
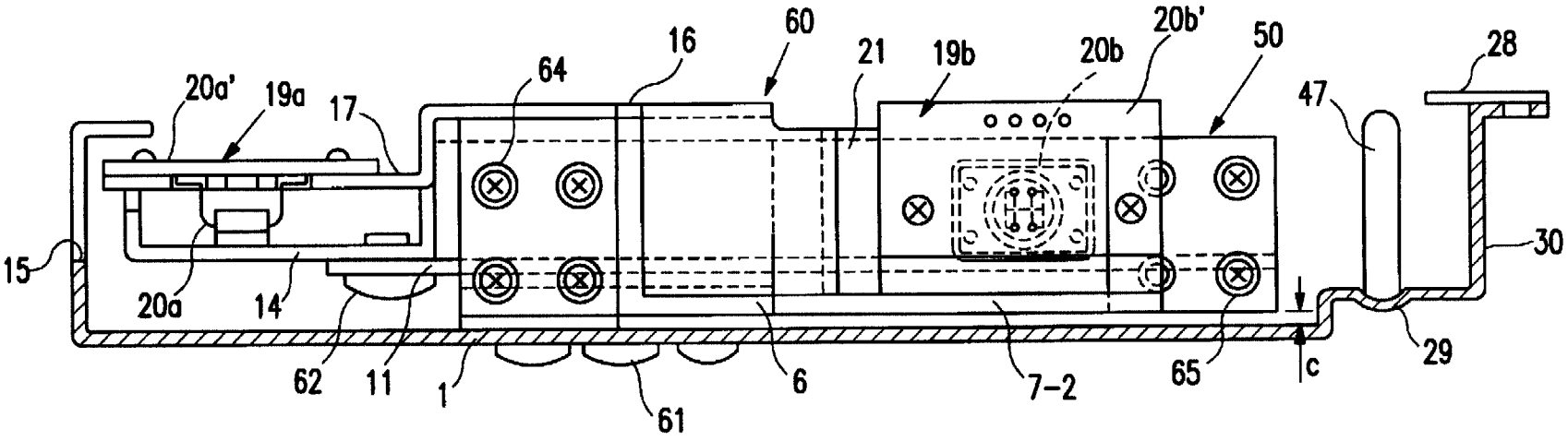

FIGS. 5 and 6 are a plan view and a side view, respectively, illustrating the sensor assembly 60 mounted in the displacement detection unit 50.

The sensor mounting bracket 16 is fixed to the side surface of the protrusion 6*b* of the fixing block 6 by screws 64, or the like, together with the leaf spring 7-2. The bracket 16 includes the sensor support sections 17 and 21. The sensor 19*a* for detecting the key depression force in the key depression-release direction and the sensor 19*b* for detecting the key depression force in the key arrangement direction are mounted to the sensor support sections 17 and 21, respectively. The sensors 19*a* and 19*b* include sensor devices 20*a* and 20*b*, respectively, fixed to mounting plate 20*a*' and 20 b', respectively. Each sensor device may be formed from an optical sensor. For example, a reflection type sensor may be used for each of the sensor devices 20*a* and 20*b*. The reflection type sensor includes a housing that is made of an elastic material, and a light emitting element and a light reception element that are mounted in the housing. A reflection surface is formed on an interior upper wall of the housing. The housing is elastically deformed in response to the resilient deformation of the leaf spring so that the reflection surface within the housing is deformed and the amount of light received is changed to detect a displacement in the leaf spring. The reflection type sensor may have a housing in the shape of an inverted cup that is similar to a movable. portion of the key switch. The sensor device 20*a* of the sensor 19*a* for detecting the key depression force in the key depression-release direction is depressed and deformed by the guide frame 14 that is connected to the leaf spring (the first resilient member) 11. Also, the sensor device 20*b* of the sensor 19*b* for detecting the key depression force in the key arrangement direction is depressed and deformed by the pressure plate section 26 of the actuator block 25. The actuator block 25 is fixed to the side surface of the protrusion 8*b* of the movable block 8 by screws 65 together with the leaf spring 7-2. Accordingly, the sensor device 20*b* of the sensor 19*b* for detecting the key depression force in the key arrangement direction is depressed and deformed by the pressure plate section 26 of the actuator 25 in response to the resilient deformation of the leaf spring 7-2. The sensor assembly 60 may be mounted in the displacement detection unit before the displacement detection unit 50 is fixed to the base member 1, or may be mounted after the displacement detection unit 50 has been fixed to the base member 1. In one embodiment, the sensor 19*a* and the guide frame 14 may be arranged in a manner that the sensor 19*a* is initially compressed by the guide frame 14 at an initial position and is expanded as the key 31 is depressed. In alternative embodiments, different sensors that use infrared detection, magnet fields, stress or the like may be used.

Figure 7:
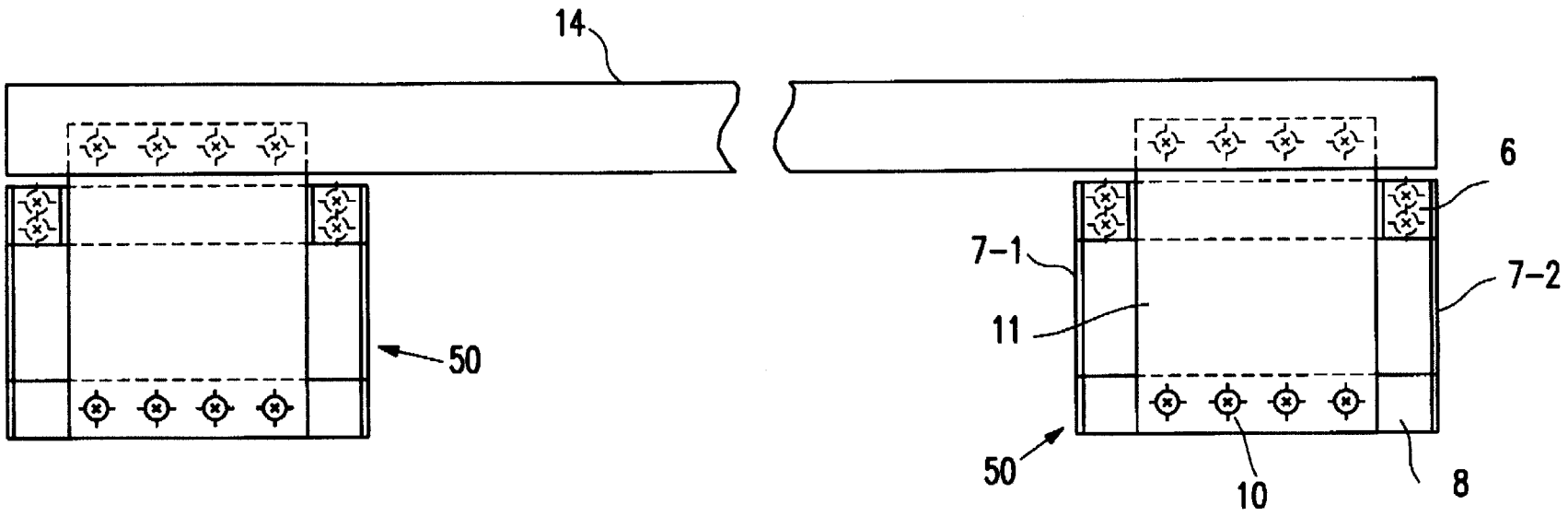

FIG. 7 is a plan view illustrating two of the displacement detection units 50 are attached to both end portions of the guide frame 14. Each of the displacement detection units 50 has the leaf springs 7-1 and 7-2 provided at both sides. As a result, the rigidity of the displacement detection unit in the key arrangement direction is enhanced, and excess stress is not generated in the leaf springs 7-1 and 7-2 when the unit is mounted to the musical instrument. Furthermore, excess stress is not generated in the leaf springs 7-1 and 7-2 when the fixing block 6 is fixed to the base member with the screws 61 or the like, or when the leaf spring 11 and the guide frame 14 are connected to each other with the screws 62 or the like. Consequently, the unit 50 can be assembled with high accuracy since the mounting angle will not readily be change by the moment force that is generated by the screw tightening work.

Figure 8:
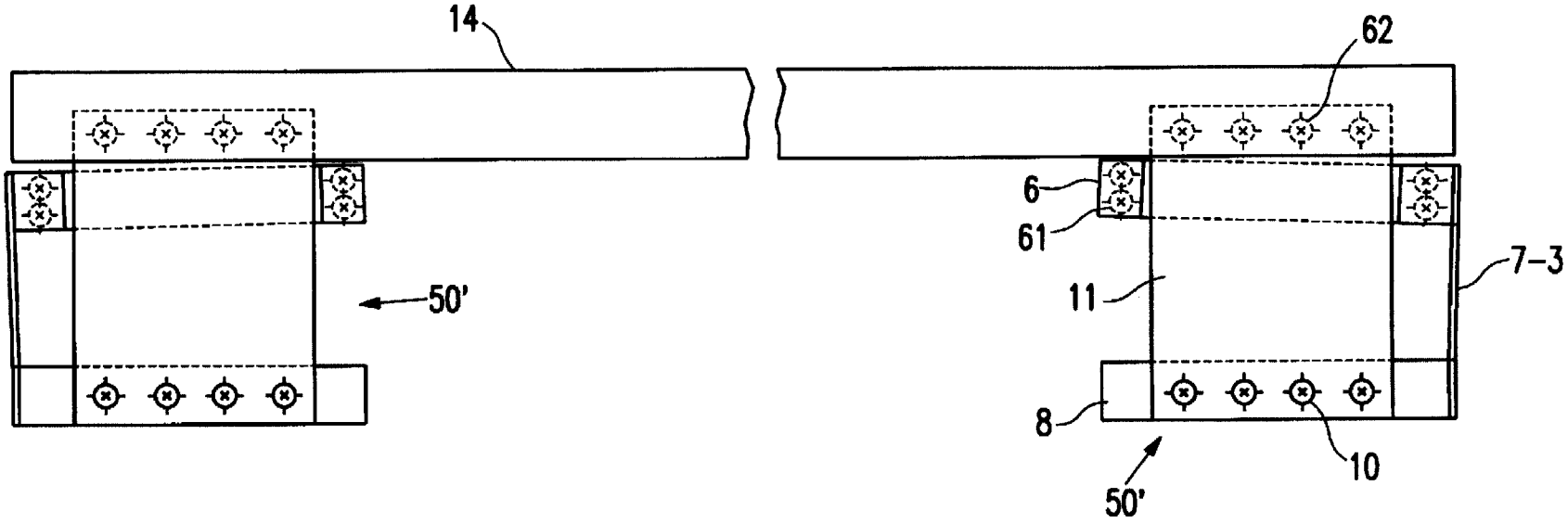

In contrast, if only one leaf spring 7-3 for detecting the key depression force in the key arrangement direction is attached to one side of each unit 50', as shown in FIG. 8, the rigidity of the unit in the key arrangement direction is relatively small. Therefore, when the unit 50' is fixed to the base member with the screws 61 and 62, or when the guide frame 14 and the leaf spring 11 are connected to each other, the fixing block 6 may be tilted or shifted from a proper position due to the torque generated by the screw tightening work. As a result, the assembly precision may be deteriorated, and thus the reliability in displacement detection may be lowered. Such problems are prevented by the structure in accordance with one embodiment of the present invention as shown in FIG. 7, in which two leaf springs are provided for detecting the key depression force in the key arrangement direction. However, it should be noted that the structure shown in FIG. 8 is also within the scope of the present invention. More particularly, in accordance with an embodiment of the present invention, the displacement detection unit shown in FIG. 8 has several advantages, such as a simplified structure. Also, the moment generated by deformation of the resilient member is folded in a manner similar to that of the above described displacement detection unit with two leaf springs 7-1 and 7-2. As a consequence, the displacement detection unit shown in FIG. 8 provides effects with respect to the accuracy of the sensor clearance similar to those provided by the displacement detection unit shown in FIG. 7

In accordance with an embodiment of the present invention, a displacement detection unit has a fixing member and resilient members (and preferably displacement detection sensors) for detecting displacements in the key depression-release direction and in the key arrangement direction are mounted on the fixing member as a unit assembly. The unit assembly is fixed to a base such as a shelf board in the body of a musical instrument. In one embodiment, stoppers are provided in a displacement detection device as a part of the unit assembly to prevent excessive load that may be applied to the resilient members in the key depression-release direction or in the key arrangement direction. In this case, clearances between the stoppers and other components in the displacement detection device can be adjusted before the unit assembly is fixed to the base member, and in advance of the overall assembly of the musical instrument. Since positioning and clearance adjustment of the various components in a displacement detection device can be performed before the displacement detection device is mounted to a musical instrument, the overall assembly work is substantially simplified and efficiency is improved In accordance with another embodiment of the present invention, a resilient member for detecting displacement in the key depression-release direction is formed in a folded structure by means of a movable block. As a result, the space for mounting the displacement detection unit is shorter in the key arrangement direction (in the depth direction of a keyboard instrument). Further, while a relatively large displacement can be detected with a short resilient member, the resilient member in the folded structure generates a smaller moment force acting on the base member. Also, a resilient member for detecting displacement in the key arrangement direction is formed substantially in a folded structure in combination with the movable member and the first resilient member. As a result, the entire structure becomes small, and the stopper clearance will not be readily affected by a deformation or a mounting angle error that may occur at a mounting section where the displacement detection unit is connected to the musical instrument.

In accordance with still another embodiment of the present invention, the second resilient member for detecting displacement in the key arrangement direction is mounted on each of the side ends of the fixing member that forms a part of a displacement detection unit. Namely, the displacement detection unit is provided with a plurality of second resilient members. As a result, the rigidity of the unit in the right and left direction is enhanced. Accordingly, when the fixing member is fixed to the musical instrument body (or the base member) with screws or the like, it is difficult for excessive stress to be generated in the resilient members. As a result, the mounting angle will not be changed by the torque that is generated by the screw tightening work, and thus the unit is assembled with a high precision.

In accordance with a further embodiment of the present invention, the fixing member has a connection section and protrusions provided at both ends. The connection section and the protrusions define a generally U-shaped cross-section as view from the front. The first resilient member is disposed inside the U-shaped groove portion of the fixing member. The first resilient member defines a folded structure by means of a movable member movable in the key arrangement direction. The first resilient member moves in the key arrangement direction with respect to the fixing block, and the protrusions at both ends of the fixing member function as a stopper device that restricts the range of movement of the first resilient member in the key arrangement direction. Furthermore, the connection section of the U-shaped fixing member functions as a stopper against the downward movement of the first resilient member placed above the connection section. As a result, a compact stopper device is provided in which clearance adjustment can be performed before the displacement detection unit is mounted in the musical instrument, and thus the overall assembly work is simplified and efficiency is improved.

In accordance with a still further embodiment of the invention, the sensors for detecting displacement in the key depression-release direction and in the key arrangement direction are mounted adjacent the fixing member. More particularly, the sensors are not directly mounted on a musical instrument, but are mounted on the fixing member that fixes the displacement detection unit to the musical instrument. As a result, a displacement in the unit can be accurately detected. For example, if the sensors were directly mounted on a shelf plate a musical instrument, the sensors would be subjected to the static and dynamic deformation of the shelf plate. In the embodiment described above, sensors are mounted on a common sensor mounting bracket. However, the fixing member may be appropriately modified so that the sensors may be directly fixed to the fixing member without using the common bracket.

In accordance with yet another embodiment of the present invention, the protrusions provided at both ends of the fixing member, that are adapted to mount the second resilient members, have recesses facing the interior sides of the second resilient members. As a result, the second resilient members can move in the key arrangement direction within the range defined by the recesses. As a consequence, while the length of the fixing member in the depth direction can be elongated to provide a larger structural rigidity to the fixing member, the range of resilient deformation of the leaf spring is widened and the leaf spring is shortened to provide a compact displacement detection unit structure.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A keyboard apparatus for an electronic musical instrument, the keyboard apparatus defining a key depression-release direction and a key arrangement direction generally transverse to the key depression-release direction, the keyboard apparatus comprising:

a key depression displacement sensor unit, the key depression displacement sensor unit including:

a first resilient member;

a first displacement detection sensor associated with the first resilient member for detection of a key depression force in the key depression-release direction;

a second resilient member coupled to the first resilient member in a unit;

a second displacement detection sensor associated with the second resilient member for detection of a key depression force in the key arrangement direction; and a fixing member to be fixed to the key board apparatus for supporting both the first and second resilient members such that the second resilient member is movable in the key arrangement direction and the first resilient member through the second resilient member is movable both in the key arrangement direction and in the key depression-release direction.

2. A keyboard apparatus according to claim 1, wherein the second resilient member has one end fixed to the fixing member and the other end fixed to a movable member that is movable in the key arrangement direction, and the first resilient member has one end fixed to the movable member and the other end extending over the fixing member, and wherein the key depression force is received by an area adjacent the other end of the first resilient member.

3. A keyboard apparatus according to claim 2, wherein the fixing member has opposing end portions and the second resilient member is attached to each of the end portions of the fixing member.

4. A keyboard apparatus according to claim 1, wherein the fixing member includes protrusions provided on the end portions and a connection section connecting the protrusions, the second resilient member being fixed to each of the protrusions of the fixing member, and the first resilient member being provided above the connection section, and wherein a clearance is formed in the key arrangement direction between side edges of each of the first resilient member and each of the protrusions to allow the first resilient member to moved in the key arrangement direction, and a clearance is formed in the key depression-release direction between a lower side of the first resilient member and an upper side of the connection section to allow the first resilient member to elastically deform in the key depression-release direction, and wherein the protrusions and the connection section of the fixing member define stoppers for the first resilient member in the key arrangement direction and the key depression-release direction, respectively.

5. A keyboard apparatus according to claim 1, wherein the first displacement detection sensor and the second displacement detection sensor are fixed adjacent the fixing member.

6. A keyboard apparatus according to claim 4, wherein the fixing member has a recess on an exterior side facing an interior side of the second resilient member to allow the second resilient member to resiliently deform.

7. A keyboard apparatus according to claim 5, wherein the fixing member has a recess on an exterior side thereof an interior side of the second resilient member to allow the second resilient member to resiliently deform.

8. A keyboard apparatus according to claim 5, wherein the first displacement detection sensor and the second displacement detection sensor are fixed to a mounting member that is connected to the fixing member.

9. A keyboard apparatus according to claim 1, wherein two of the key depression displacement sensor units are mounted on both end portions of a guide frame.

10. A key displacement detection unit for an electronic keyboard apparatus defining a key depression-release direction and a key arrangement direction transverse to the key depression-release direction, the key displacement detection unit comprising:

a first resilient member;

a movable member connected to the first resilient member;

a second resilient member connected to the movable member wherein the first resilient member and the second resilient member define a folded structure about the movable member; and a base fixing member connected to the second resilient member and spaced a distance from the first resilient member.

11. A key displacement detection unit for an electronic keyboard apparatus according to claim 10, wherein the first resilient member has a front end portion for receiving a key depression force and a rear end portion connected to the movable member, and the second resilient member has a front end portion connected to the base fixing member and a rear end portion connected to the movable member, and wherein the front end portion of the first resilient member is located adjacent the base fixing member.

12. A key displacement detection unit for an electronic keyboard apparatus according to claim 10, wherein the first resilient member is flexible in the key depression-release direction and movable in the key arrangement direction, and wherein the second resilient member is flexible in the key arrangement direction and substantially rigid in the key depression-release direction.

13. A key displacement detection unit for an electronic keyboard apparatus according to claim 10, further comprising a first displacement detection sensor coupled with the first resilient member for detecting a key depression force in the key depression-release direction and a second displacement detection sensor coupled with the second resilient member for detecting a key depression force in the key arrangement direction.

14. A key displacement detection unit for an electronic keyboard apparatus according to claim 13, further comprising a mounting bracket member fixed to the base fixing member, wherein the first displacement detection sensor and the second displacement detection sensor are mounted on the mounting bracket member.

15. A key displacement detection unit for an electronic keyboard apparatus according to claim 10, wherein the base fixing member has upwardly extending protrusions on both ends thereof and a connection section connecting the protrusions, the protrusions and the connection section generally defining a channel for receiving the first resilient member, and wherein the first resilient member is separated from the channel to allow the first resilient member to assume resilient movement both in the key arrangement direction and in the key depression-release direction.

16. A key displacement detection unit for an electronic keyboard apparatus according to claim 15, wherein each of the protrusions of the base fixing member has a side surface extending generally in the key depression-release direction, and wherein the second resilient member is attached to the side surface of at least one of the protrusions of the base fixing member.

17. A key displacement detection unit for an electronic keyboard apparatus according to claim 16, wherein the side surface of the protrusion of the base fixing member has a step-wise recess to provide a clearance with respect to the second resilient member to allow the second resilient member to assume resilient movement in the key arrangement direction.

18. A key displacement detection unit for an electronic keyboard apparatus according to claim 10, wherein the first resilient member is a leaf spring disposed in a plane generally extending in the key arrangement direction and the second resilient member is a leaf spring disposed in a plane generally extending in the key arrangement direction.

19. A key displacement detection unit for an electronic keyboard apparatus defining a key depression-release direction and a key arrangement direction transverse to the key depression-release direction, the key displacement detection unit comprising:

a first leaf spring disposed in a plane generally extending in the key arrangement direction and having a front end portion for receiving a key depression force and a rear end portion;

a movable block connected to the first leaf spring at the rear end portion;

at least a second leaf spring disposed in a plane generally extending in the key depression-release direction and having a front end portion and a rear end portion, the second leaf spring being connected at the rear end portion thereof to the movable block wherein the first leaf spring and the second leaf spring define a folded structure about the movable block; and a base fixing member connected to the front end portion of the second leaf spring, wherein the front end portion of the first leaf spring is flexible in the key depression-release direction and movable in the key arrangement direction, and the second leaf spring is flexible in the key arrangement direction.

20. A key displacement detection unit for an electronic keyboard apparatus according to claim 19, wherein the base fixing member has two end portions in the key arrangement direction and the second leaf spring is fixed to each of the end portions of the base fixing member.

21. A key displacement detection unit for an electronic keyboard apparatus according to claim 20, wherein the base fixing member has upwardly extending protrusions on the both end portions and a connection section connecting the protrusions, the protrusions and the connection section generally defining a channel for receiving the first leaf spring, and wherein the first leaf spring is separated from the channel to allow the first leaf spring to assume resilient movement both in the key arrangement direction and in the key depression-release direction.

22. A key displacement detection unit for an electronic keyboard apparatus according to claim 21, wherein each of the protrusions of the base fixing member has a side surface extending generally in the key depression-release direction, the side surface of at least one of the protrusions of the base fixing member having a step-wise recess to provide a clearance with respect to the second leaf spring to allow the second leaf spring to assume resilient movement in the key arrangement direction.

* * * * *